US007721709B2

(12) United States Patent
Shinohara et al.

(10) Patent No.: US 7,721,709 B2
(45) Date of Patent: May 25, 2010

(54) FUEL INJECTION CONTROL APPARATUS AND METHOD FOR INTERNAL COMBUSTION ENGINE

(75) Inventors: Toshinari Shinohara, Saitama-ken (JP); Ken Ogawa, Saitama-ken (JP); Toru Kitamura, Saitama-ken (JP); Chiho Itoga, Saitama-ken (JP)

(73) Assignee: Honda Motor Co., Ltd., Tokyo (JP)

( * ) Notice: Subject to any disclaimer, the term of this patent is extended or adjusted under 35 U.S.C. 154(b) by 61 days.

(21) Appl. No.: 12/005,363

(22) Filed: Dec. 27, 2007

(65) Prior Publication Data

US 2008/0162015 A1 Jul. 3, 2008

(30) Foreign Application Priority Data

Dec. 28, 2006 (JP) ..... 2006-355543

(51) Int. Cl.
*F02B 1/00* (2006.01)
*F02B 7/00* (2006.01)

(52) U.S. Cl. ..... 123/429; 123/431

(58) Field of Classification Search ..... 123/429, 123/431, 432, 434, 478, 480, 299, 300, 305; 701/103, 104
See application file for complete search history.

(56) References Cited

U.S. PATENT DOCUMENTS 6,988,490 B2 * 1/2006 Satou ..... 123/480
7,165,533 B2 * 1/2007 Adachi et al. ..... 123/431
7,234,447 B2 * 6/2007 Okubo et al. ..... 123/431
2002/0020393 A1 * 2/2002 Ogawa et al. ..... 123/406.26
2005/0172931 A1 * 8/2005 Mori ..... 123/305
2005/0193981 A1 * 9/2005 Sakai et al. ..... 123/431
2006/0000452 A1 * 1/2006 Tokuda et al. ..... 123/456
2006/0021595 A1 * 2/2006 Miyashita ..... 123/299
2006/0207566 A1 * 9/2006 Kobayashi ..... 123/431
2006/0225703 A1 * 10/2006 Saito et al. ..... 123/431
2007/0169746 A1 * 7/2007 Irisawa ..... 123/431

FOREIGN PATENT DOCUMENTS

JP 07-166922 A 6/1995
JP 2006-144655 A 6/2006
JP 2006-258007 A 9/2006

* cited by examiner

*Primary Examiner*—John T Kwon
(74) *Attorney, Agent, or Firm*—Arent Fox LLP

(57) ABSTRACT

A fuel injection control apparatus and method for an internal combustion engine are provided for appropriately controlling the amounts of fuel supplied from an in-cylinder fuel injection valve and a port fuel injection valve to a cylinder in a simple control approach while satisfactorily reflecting a fuel transport behavior as a whole cylinder. An ECU calculates a required in-cylinder injection amount and a required port injection amount, calculates an in-cylinder injected fuel behavior parameter of a fuel from the in-cylinder fuel injection valve and a port injected fuel behavior parameter of the fuel from the port fuel injection valve, a net in-cylinder injection amount in accordance with the in-cylinder and port injected fuel behavior parameters based on the required in-cylinder injection amount, and a net port injection amount in accordance with the in-cylinder and port injected fuel behavior parameters based on the required port injection amount.

6 Claims, 12 Drawing Sheets

FUEL INJECTION CONTROL APPARATUS AND METHOD FOR INTERNAL COMBUSTION ENGINE

BACKGROUND OF THE INVENTION

1. Field of the Invention

The present invention relates to a fuel injection control apparatus and method for an internal combustion engine which is supplied with a fuel by an in-cylinder fuel injection valve for injecting the fuel into a cylinder, and a port fuel injection valve for injecting the fuel into an intake system including an intake port.

2. Description of the Prior Art

Conventionally, as this type of fuel injection control apparatus for an internal combustion engine, one described, for example, in Laid-open Japanese Patent Application No. 2005-337102 is known. In this fuel injection control apparatus, the proportion of an in-cylinder injection amount injected from an in-cylinder fuel injection valve to a port injection amount injected from a port fuel injection valve is set in accordance with a detected operating condition of an internal combustion engine. Also, when the proportion of the port injection amount decreases while the proportion of the port injection amount increases, an increased amount of the port injection amount is divided into a primary injection for injecting an amount of fuel in accordance with the operating condition of the internal combustion engine, and a secondary injection which precedes the primary injection. Also, the amount of fuel injected in the secondary injection is set to the amount of fuel sticking to the inner wall of an intake passage, thereby compensating for a lack of fuel supplied to a combustion chamber due to the fuel sticking to the inner wall of the intake passage.

When a port fuel injection valve is provided in conjunction with an in-cylinder fuel injection valve, as is the case with the foregoing conventional internal combustion engine, the sticking of fuel is not limited to a fuel injected from the port fuel injection valve, but is involved in a fuel injected from the in-cylinder fuel injection valve, where the fuel can stick to the inner wall surface of a combustion chamber, for example, the inner wall surface of a cylinder, the top surface of a piston, and the like. However, in the conventional fuel injection control apparatus, a correction against the sticking is made only for a fuel injected from the port fuel injection valve, so that a fuel transport behavior of the whole cylinder, including the sticking of a fuel injected from the in-cylinder fuel injection valve, is not reflected. As a result, the amount of fuel actually used in the combustion in the combustion chamber cannot be appropriately controlled, failing to achieve a desired air-fuel ratio.

Also, in this fuel injection control apparatus, the correction against the sticking is performed exclusively in an operating condition in which the proportion of the port injection amount is increasing, so that an appropriate fuel injection amount reflecting a fuel transport behavior cannot be set in other operating conditions of the internal combustion engine. Further, since fuel injection amounts are set by control approaches different from each other between the operating condition in which the proportion of the port injection amount is increasing and other operating conditions, the entire control logic is complicated, and the air-fuel ratio is more likely to vary before and after switching between the control approaches.

SUMMARY OF THE INVENTION

The present invention has been made to solve the problems as mentioned above, and it is an object of the invention to provide a fuel injection control apparatus and method for an internal combustion engine which are capable of appropriately controlling the amounts of fuel supplied from an in-cylinder fuel injection valve and a port fuel injection valve to a cylinder in a simple control approach while satisfactorily reflecting a fuel transport behavior as a whole cylinder.

To achieve the above object, according to a first aspect of the present invention, there is provided a fuel injection control apparatus for an internal combustion engine which is supplied with a fuel by an in-cylinder fuel injection vale for injecting the fuel into a cylinder, and a port fuel injection valve for injecting the fuel into an intake system including an intake port. The fuel injection control apparatus is characterized by comprising required in-cylinder injection amount calculating means for calculating a required in-cylinder injection amount required for the in-cylinder fuel injection valve; required port injection amount calculating means for calculating a required port injection amount required for the port fuel injection valve; in-cylinder injected fuel behavior parameter calculating means for calculating an in-cylinder injected fuel behavior parameter indicative of a transport behavior of a fuel injected by the in-cylinder fuel injection valve; port injected fuel behavior parameter calculating means for calculating a port injected fuel behavior parameter indicative of a transport behavior of the fuel injected by the port fuel injection valve; net in-cylinder injection amount determining means for determining a net in-cylinder injection amount which should be injected from the in-cylinder fuel injection valve in accordance with the calculated in-cylinder injected fuel behavior parameter and port injected fuel behavior parameter based on the calculated required in-cylinder injection amount; and net port injection amount determining means for determining a net port injection amount which should be injected from the port fuel injection valve in accordance with the in-cylinder injected fuel behavior parameter and the port injected fuel behavior parameter based on the calculated required port injection amount.

According to this fuel injection control apparatus for an internal combustion engine, the required in-cylinder injection amount required for the in-cylinder fuel injection valve, and the required port injection amount required for the port fuel injection valve are calculated, respectively. Also, the in-cylinder injected fuel behavior parameter indicative of a transport behavior of a fuel injected from the in-cylinder fuel injection valve, and the port injected fuel behavior parameter indicative of a transport behavior of the fuel injected from the port fuel injection valve are calculated, respectively. Then, the net in-cylinder injection amount which should be actually injected from the in-cylinder fuel injection valve is determined in accordance with the in-cylinder injected fuel behavior parameter and the port injected fuel behavior parameter based on the required in-cylinder injection amount. Also, the net port injection amount which should be actually injected from the port fuel injection valve is determined in accordance with the in-cylinder injected fuel behavior parameter and the port injected fuel behavior parameter based on the required port injected amount.

As described above, according to the present invention, the net in-cylinder injection amount from the in-cylinder fuel injection valve and the net port injection amount from the port fuel injection valve are determined in accordance with the in-cylinder injected fuel behavior parameter and the port injected fuel behavior parameter. Accordingly, the amount of fuel actually used in a combustion chamber for combustion can be appropriately controlled while satisfactorily reflecting fuel transport behaviors as the whole cylinder including not only a transport delay due to the sticking of the fuel injected from the port fuel injection valve onto the inner wall surface of an intake system, but also a transport delay due to the sticking of the fuel injected from the in-cylinder fuel injection valve onto the inner wall surface of the combustion chamber, and the like, thereby making it possible to accurately control the air-fuel ratio to a desired value.

Also, since the control approach described above can be applied irrespective of the operating condition of the internal combustion engine, the control logic can be simplified, and the air-fuel ratio can be controlled with stability, as compared with the aforementioned conventional control apparatus which needs to switch control approaches in accordance with a particular operating condition.

To achieve the above object, according to a second aspect of the present invention, there is provided a fuel injection control method for an internal combustion engine which is supplied with a fuel by an in-cylinder fuel injection vale for injecting the fuel into a cylinder, and a port fuel injection valve for injecting the fuel into an intake system including an intake port. The fuel injection control method is characterized by comprising the steps of calculating a required in-cylinder injection amount required for the in-cylinder fuel injection valve; calculating a required port injection amount required for the port fuel injection valve; calculating an in-cylinder injected fuel behavior parameter indicative of a transport behavior of a fuel injected by the in-cylinder fuel injection valve; calculating a port injected fuel behavior parameter indicative of a transport behavior of the fuel injected by the port fuel injection valve; determining a net in-cylinder injection amount which should be injected from the in-cylinder fuel injection valve in accordance with the calculated in-cylinder injected fuel behavior parameter and port injected fuel behavior parameter based on the calculated required in-cylinder injection amount; and determining a net port injection amount which should be injected from the port fuel injection valve in accordance with the in-cylinder injected fuel behavior parameter and the port injected fuel behavior parameter based on the calculated required port injection amount.

This method provides the same advantageous effects as described above concerning the abnormality determining apparatus according to the first aspect of the invention.

Preferably, the fuel injection control apparatus for an internal combustion engine further comprises load detecting means for detecting a load of the internal combustion engine; total required fuel amount calculating means for calculating a total required fuel amount required for the whole cylinder based on the detected load of the internal combustion engine; and engine temperature detecting means for detecting a temperature of the internal combustion engine, wherein the in-cylinder injected fuel behavior parameter calculating means calculates the in-cylinder injected fuel behavior parameter in accordance with one of the calculated total required fuel amount and the required in-cylinder injection amount and the detected temperature of the internal combustion engine, and the port injected fuel behavior parameter calculating means calculates the port injected fuel behavior parameter in accordance with one of the total required fuel amount and the required port injection amount and the temperature of the internal combustion engine.

Generally, a degree to which the fuel sticks to the inner wall surfaces of the intake system and combustion chamber is largely affected by the temperature of the internal combustion engine, and is larger as the temperature is lower because the fuel is less apt to vaporize. Also, the required fuel injection amount represents a load on the internal combustion engine, and additionally reflects the thickness of a fuel film sticking to the inner wall surface of the intake system, and the like, unlike other load parameters. Therefore, according to the present invention, the in-cylinder injected fuel behavior parameter can be appropriately calculated in accordance with one of the total required fuel amount and the required in-cylinder injection amount and the temperature of the internal combustion engine. Also, the in-cylinder injected fuel behavior parameter can be appropriately calculated in accordance with one of the total required fuel amount and the required port injection amount and the temperature of the internal combustion engine. Consequently, it is possible to more appropriately determine the net in-cylinder injection amount and the net port injection amount in accordance with both fuel behavior parameters.

Preferably, the fuel injection control method for an internal combustion engine further comprises the step of detecting a load of the internal combustion engine; calculating a total required fuel amount required for the whole cylinder based on the detected load of the internal combustion engine; and detecting a temperature of the internal combustion engine, wherein the in-cylinder injected fuel behavior parameter calculating step includes calculating the in-cylinder injected fuel behavior parameter in accordance with one of the calculated total required fuel amount and the required in-cylinder injection amount and the detected temperature of the internal combustion engine, and the port injected fuel behavior parameter calculating step includes calculating the port injected fuel behavior parameter in accordance with one of the total required fuel amount and the required port injection amount and the temperature of the internal combustion engine.

This preferred embodiment of the fuel injection control method provides the same advantageous effects as described above concerning the fuel injection control apparatus according to the first aspect of the invention.

Preferably, the fuel injection control apparatus for an internal combustion engine further comprises total fuel behavior parameter calculating means for calculating a total fuel behavior parameter indicative of a transport behavior of the fuel as the whole cylinder by weight averaging the in-cylinder injected fuel behavior parameter and the port injected fuel behavior parameter in accordance with ratios of the required in-cylinder injection amount and the required port injection amount to the total required fuel amount; and total net injection amount calculating means for calculating a total net injection amount which is a sum total of fuel amounts that should be injected from the in-cylinder fuel injection valve and the port fuel injection valve in accordance with the calculated total fuel behavior parameter, wherein the net in-cylinder injection amount determining means and the net port injection amount determining means determine the net in-cylinder injection amount and the net port injection amount, respectively, by proportionally distributing the calculated total net injection amount in accordance with ratios of the required in-cylinder injection amount and the required port injection amount.

According to this preferred embodiment of the fuel injection control apparatus for an internal combustion engine, the total fuel behavior parameter as the whole cylinder is calculated by weight averaging the in-cylinder injected fuel behavior parameter and the port injected fuel behavior parameter in accordance with the ratios of the required in-cylinder injection amount and the required port injection amount to the total required fuel amount. Therefore, the calculated total fuel behavior parameter satisfactorily reflects a transport behavior of the fuel as the whole cylinder. Also, the total net injection amount is calculated in accordance with the total fuel behavior parameter, and the net in-cylinder injection amount and the net port injection amount are determined respectively by proportionally distributing the calculated total net injection amount in accordance with the ratios of the required in-cylinder injection amount and the required port injection amount.

Accordingly, it is possible to appropriately determine the net in-cylinder injection amount and the net port injection amount, while satisfactorily reflecting the transport behavior of the fuel as the whole cylinder, to accurately control the air-fuel ratio to a desired value. Also, since the final net in-cylinder injection amount and net port injection amount can be calculated simply by calculating the total fuel behavior parameter by the weighted average of the in-cylinder injected fuel behavior parameter and the port injected fuel behavior parameter, and proportionally distributing the calculated total net injection amount in accordance with the total fuel behavior parameter, the foregoing actions can be provided by such an extremely simple processing approach.

Preferably, the fuel injection control method for an internal combustion engine further comprises the step of calculating a total fuel behavior parameter indicative of a transport behavior of the fuel as the whole cylinder by weight averaging the in-cylinder injected fuel behavior parameter and the port injected fuel behavior parameter in accordance with ratios of the required in-cylinder injection amount and the required port injection amount to the total required fuel amount; and calculating a total net injection amount which is a sum total of fuel amounts that should be injected from the in-cylinder fuel injection valve and the port fuel injection valve in accordance with the calculated total fuel behavior parameter, wherein the net in-cylinder injection amount determining step and the net port injection amount determining step include determining the net in-cylinder injection amount and the net port injection amount, respectively, by proportionally distributing the calculated total net injection amount in accordance with ratios of the required in-cylinder injection amount and the required port injection amount.

This preferred embodiment of the fuel injection control method provides the same advantageous effects as described above concerning the fuel injection control apparatus according to the first aspect of the invention.

DETAILED DESCRIPTION OF THE EMBODIMENT

Figure 1:
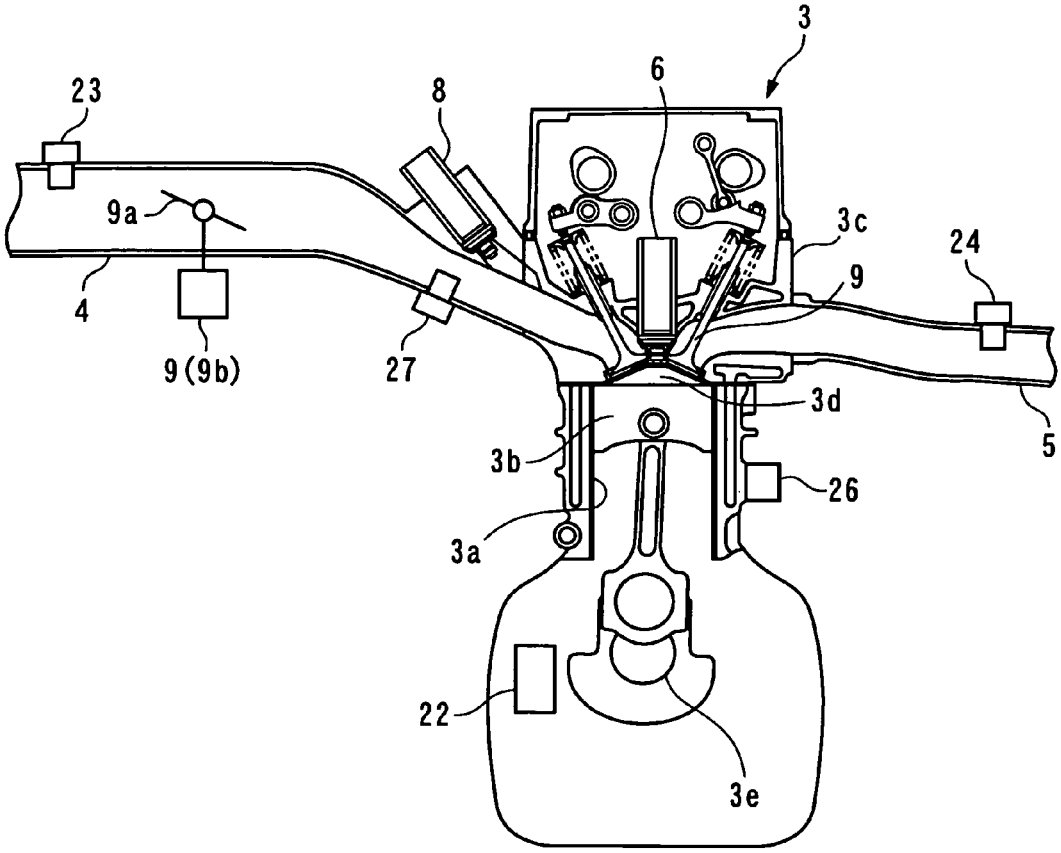
FIG. 1 is a diagram generally showing an internal combustion engine to which a fuel injection control apparatus according to the present invention is applied.

In the following, a preferred embodiment of the present invention will be described with reference to the drawings. FIG. 1 generally shows an internal combustion engine 3 to which a fuel injection control apparatus 1 according to this embodiment is applied. The internal combustion engine (hereinafter referred to as the "engine") 3 is, for example, an in-line four-cylinder type four cycle gasoline engine which is equipped in a vehicle (not shown).

Figure 2:
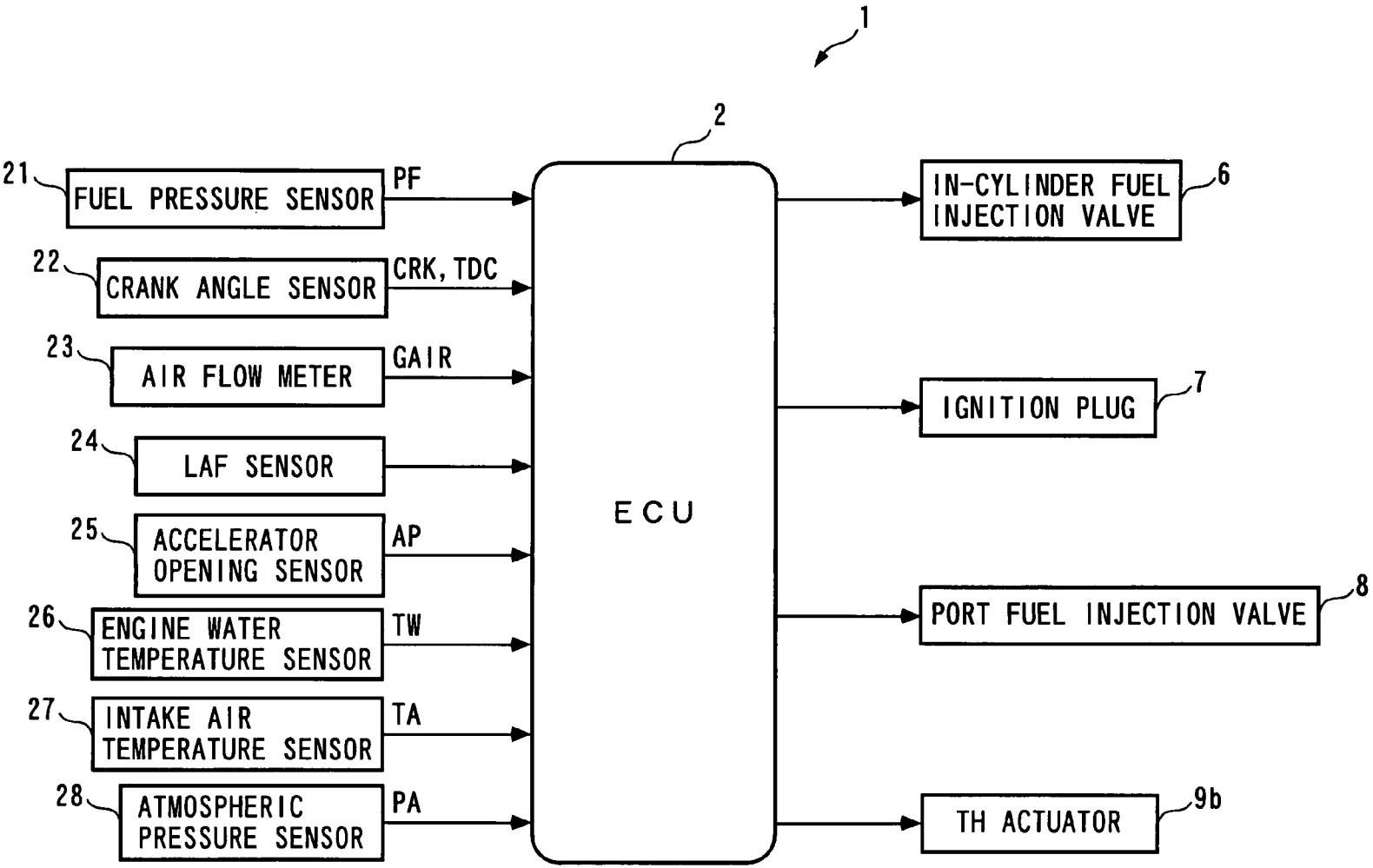
FIG. 2 is a block diagram of the fuel injection control apparatus.

A cylinder head 3*c* of the engine 3 is connected to an intake pipe 4 (intake system) and an exhaust pipe 5 for each cylinder 3*a*, and an in-cylinder fuel injection valve 6 and an ignition plug 7 (see FIG. 2) are attached to face a combustion chamber 3*d* (only one each of which is shown in FIG. 1). This in-cylinder fuel injection valve 6 is configured to inject a fuel in the vicinity of an ignition plug 7 within the cylinder 3*a*. Also, a valve opening time and valve opening/closing timings of the in-cylinder fuel injection valve 6, as well as an ignition timing of the ignition plug 7 are controlled by an ECU, later described, of the control apparatus 1.

The in-cylinder fuel injection valve 6 is also connected to a fuel tank (not shown) by way of a first fuel pump and a fuel pipe (non of which is shown), such that a fuel stored in the fuel tank is boosted to a high pressure by this first fuel pump and supplied into the in-cylinder fuel injection valve 6. The operation of the first fuel pump is controlled by the ECU 2, thereby controlling the pressure PF of the fuel supplied to the in-cylinder fuel injection valve 6 (hereinafter referred to as the "in-cylinder fuel pressure). The in-cylinder fuel pressure PF is basically controlled to a predetermined reference in-cylinder fuel pressure PFREF (for example, 10 MPa). Also, near the in-cylinder fuel injection valve 6 in the fuel pipe, a fuel pressure sensor 21 (see FIG. 2) (fuel pressure detecting means) is attached, and this fuel pressure sensor 21 outputs a detection signal indicative of the in-cylinder fuel pressure PF to the ECU 2.

The engine 3 is provided with a crank angle sensor 22. The crank angle sensor 22 is made up of a magnet rotor and an MRE pickup (none of which is shown), and outputs a CRK signal and a TDC signal, both of which are pulse signals, to the ECU 2 in association with the rotation of a crank shaft 3*e*.

This CRK signal is output every predetermined crank angle (for example, every 30°). The ECU 2, based on the CRK signal, calculates the rotational speed NE of the engine 3 (hereinafter referred to as the "engine rotational speed"). The aforementioned TDC signal is a signal which indicates that the piston 3*b* of the cylinder 3*a* is present at a predetermined crank angle position near the TDC (top dead center) at the start of an intake stroke, and one pulse is output every 180° of the crank angle in this example which is a four-cylinder type. The engine 3 is also provided with a cylinder discrimination sensor (not shown). This cylinder discrimination sensor outputs a cylinder discrimination signal, which is a pulse signal for discriminating the cylinder 3*a*, to the ECU 2. The ECU 2 calculates a crank angle position CA for each cylinder 3*a* in accordance with these cylinder discrimination signal, CRK signal and TDC signal.

A port fuel injection valve 8 is provided in an intake manifold of the intake pipe 4 for each cylinder 3*a* to face a intake port. This port fuel injection valve 8 is connected to a second fuel pump. The fuel is boosted to a high-pressure by this second fuel pump, and is then supplied to the port fuel injection valve 8. The operation of the second fuel pump is controlled by the ECU 2, thereby controlling the pressure of the fuel supplied to the port fuel injection valve 8 (hereinafter referred to as the "port fuel pressure"). The port fuel pressure is basically controlled to a predetermined reference port fuel pressure (for example, 350 kPa) lower than the aforementioned reference in-cylinder fuel pressure PFREF. Also, a valve opening time and valve opening/closing timings of the port fuel injection valve 8 are controlled by the ECU 2.

The intake pipe 4 is also provided with a throttle valve mechanism 9. The throttle valve mechanism 9 has a throttle valve 9*a* and a TH actuator 9*b* for driving the same to open and close. The throttle valve 9*a* is pivotably provided within the intake pipe 4, to change an intake air amount QA with a change in opening associated with the pivotal movement. The TH actuator 9*b* is a combination of a motor with a gear mechanism (none of which is shown), and is driven by a driving signal from the ECU 2 to control the opening of the throttle valve 9*a*.

An air flow meter 23 is provided in an air inlet of the intake pipe 4 for detecting the mass of air flowing through the intake pipe 4 (hereinafter referred to as the "air mass"), and its detection signal is output to the ECU 2.

The exhaust pipe 5 is provided with an LAF sensor 24. The LAF sensor 24 linearly detects the oxygen concentration within exhaust gases which flows through the exhaust pipe 5 in a wide region of air-fuel-ratio from a richer region than the stoichiometric air-fuel ratio to an extremely lean region, and outputs its detection signal to the ECU 2. The ECU 2 calculates a detected air-fuel ratio KACT indicative of the actual air-fuel ratio of an air-fuel mixture mixed in the combustion chamber 4*d* based on the oxygen concentration detected by the LAF sensor 24. In this event, the detected air-fuel ratio KACT is calculated as an equivalence ratio.

The ECU 2 is further supplied with a detection signal indicative of an accelerator pedal manipulation amount (hereinafter referred to as the "accelerator opening") AP from an accelerator opening sensor 25; a detection signal indicative of the temperature TW of cooling water which circulates within the body of the engine 3 (hereinafter referred to as the "engine water temperature") from an engine water temperature sensor 26 (engine temperature detecting means); a detection signal indicative of the temperature TA of intake air inhaled into the engine 3 (hereinafter referred to as the "intake air temperature") from an intake air temperature sensor 27; and a detection signal indicative of the atmospheric pressure PA from an atmospheric pressure sensor 28.

The ECU 2 is based on a microcomputer which is comprised of an I/O interface, a CPU, a RAM, a ROM and the like. Also, the ECU 2 determines the operating condition of the engine 3 in accordance with the detection signals from a variety of sensors 21-28 mentioned above, determines a combustion mode of the engine 3, and executes a fuel injection control process in accordance with the determined combustion mode. In this regard, the ECU 2 is comparable to a required in-cylinder injection amount calculating means, a required port injection amount calculating means, an in-cylinder injected fuel behavior parameter calculating means, a port injected fuel behavior parameter calculating means, a net in-cylinder injection amount determining means, a net port injection amount determining means, a total required fuel amount calculating means, a total fuel behavior parameter calculating means, and a total net injection amount calculating means in this embodiment.

The combustion mode is one of a stratified self ignition combustion mode, a stratified flame propagation combustion mode, a torch self combustion mode, and a homogeneous flame propagation combustion mode.

(1) Stratified self ignition combustion mode: a combustion mode which involves producing a stratified air-fuel mixture by injecting a fuel during a compression stroke by the in-cylinder fuel injection valve 6 and burning the same with self injection.

(2) Stratified flame propagation combustion mode: a combustion mode which involves producing a stratified air-fuel mixture by injecting a fuel during a compression stroke by the in-cylinder fuel injection valve 6 and burning the same with flame propagation through a spark ignition by the ignition plug 7.

(3) Torch self ignition combustion mode: after producing a homogenous air-fuel mixture by injecting a fuel during an intake stroke by the port fuel injection valve 8, a trace of fuel is injected during a compression stroke by the in-cylinder fuel injection valve 6, thereby generating an air-fuel mixture which includes both of the homogeneous air-fuel mixture and the stratified air-fuel mixture. Then, the produced stratified air-fuel mixture is burnt with flame propagation through a spark ignition, and the homogeneous air-fuel mixture is burnt with self ignition using this as a torch.

(4) Homogeneous flame propagation combustion mode: a combustion mode which involves producing a stratified air-fuel mixture by injecting a fuel during a compression stroke by the in-cylinder fuel injection valve 6 and burning with flame propagation through spark ignition.

The determination of the combustion mode is made in accordance with the engine rotational speed NE and a required torque PMCMD required by the engine 3, and the value of a combustion mode monitor STS_BURNCMD indicative of the combustion mode is set to any of 1-4.

More specifically describing, when the engine rotational speed NE is in a predetermined low rotation region with the required torque PMCMD being in a predetermined low load region, in other words, when the operating condition of the engine 3 is in a predetermined first operating region, the stratified self ignition combustion mode is selected, so that the combustion mode monitor STS_BURNCMD is set to "1." On the other hand, when the engine rotational speed NE is in a low-middle rotation region with the required torque being in a lower load region than the first operating region, in other words, when the operating condition of the engine 3 is in a predetermined second operating region (region in which the stratified air-fuel mixture does not burn with self ignition), the stratified flame propagation combustion mode is selected, so that the combustion mode monitor STS_BURNCMD is set to "2."

Further, when the engine rotational speed NE is in the low-middle rotation region with the required torque PMCMD being in a higher load region than the predetermined first operating region, in other words, when the operating condition of the engine 3 is in a predetermined third operating region, the torch self ignition combustion mode is selected, so that the combustion mode monitor STS_BURNCMD is set to "3." Also, when the operating condition of the engine 3 represented by the engine rotational speed NE and the required torque PMCMD is in a predetermined fourth operating region other than the aforementioned first to third operating region, the homogeneous flame propagation combustion mode is selected, and the combustion mode monitor STS_BURNCMD is set to 114.

Figure 3:
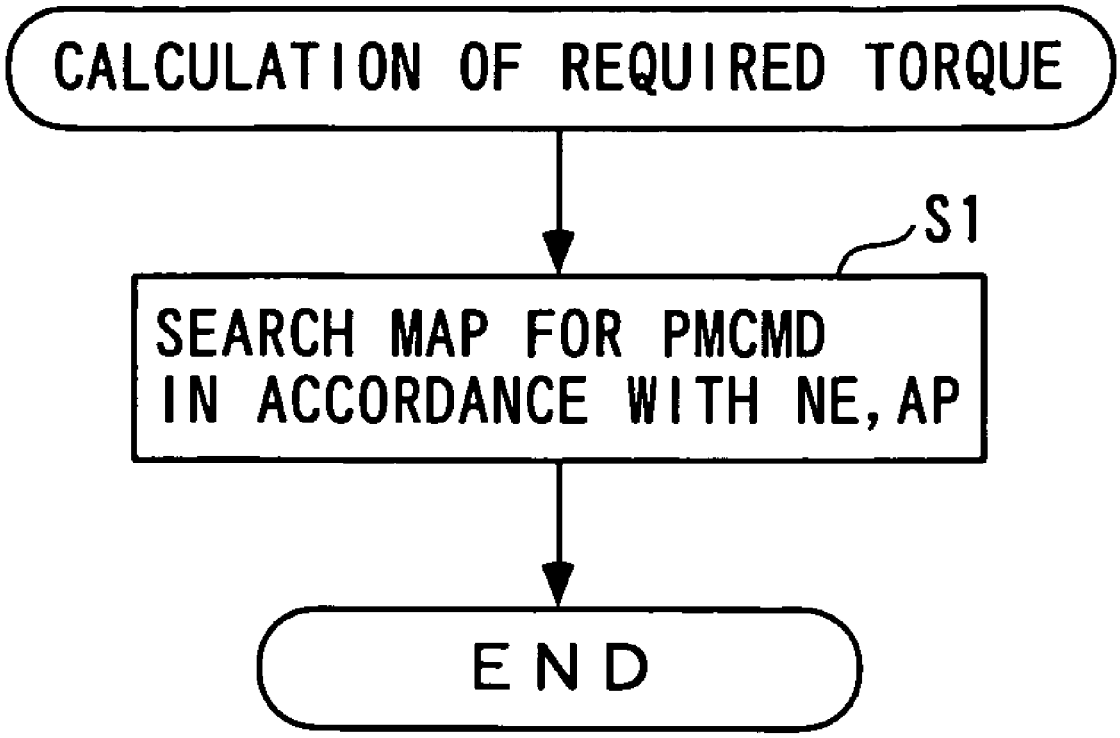
FIG. 3 is a flow chart showing a required torque calculation process.

Further, the required torque PMCMD is calculated by searching a map (not shown) in accordance with the engine rotational speed NE and the accelerator opening AP at step 1 (labeled "S1" in the figure. The same is applied to the following description) in FIG. 3.

Figure 4:
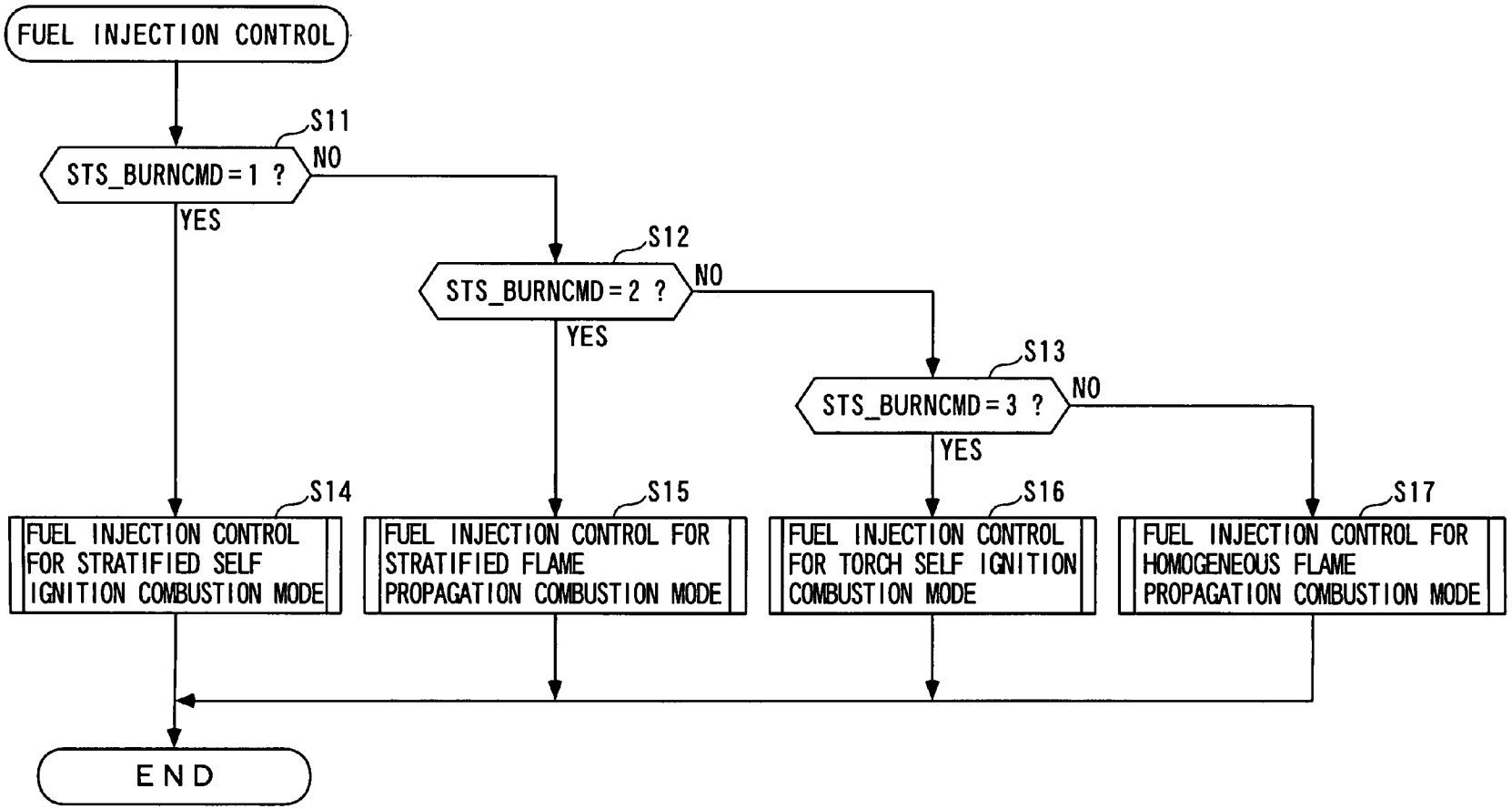
FIG. 4 is a flow chart showing a fuel injection control process.

Next, a fuel injection control process will be described with reference to FIG. 4. This process is executed in synchronism with the input of a TDC signal. First, at steps 11-13, it is determined whether or not the combustion mode monitor STS_BURNCMD is "1"-"3," respectively. In other words, it is determined which of the four combustion modes the current combustion mode is set in. Then, in accordance with the result of the discrimination, fuel injection control for each mode is executed at steps 14-17, followed by the termination of this process.

Figure 5:
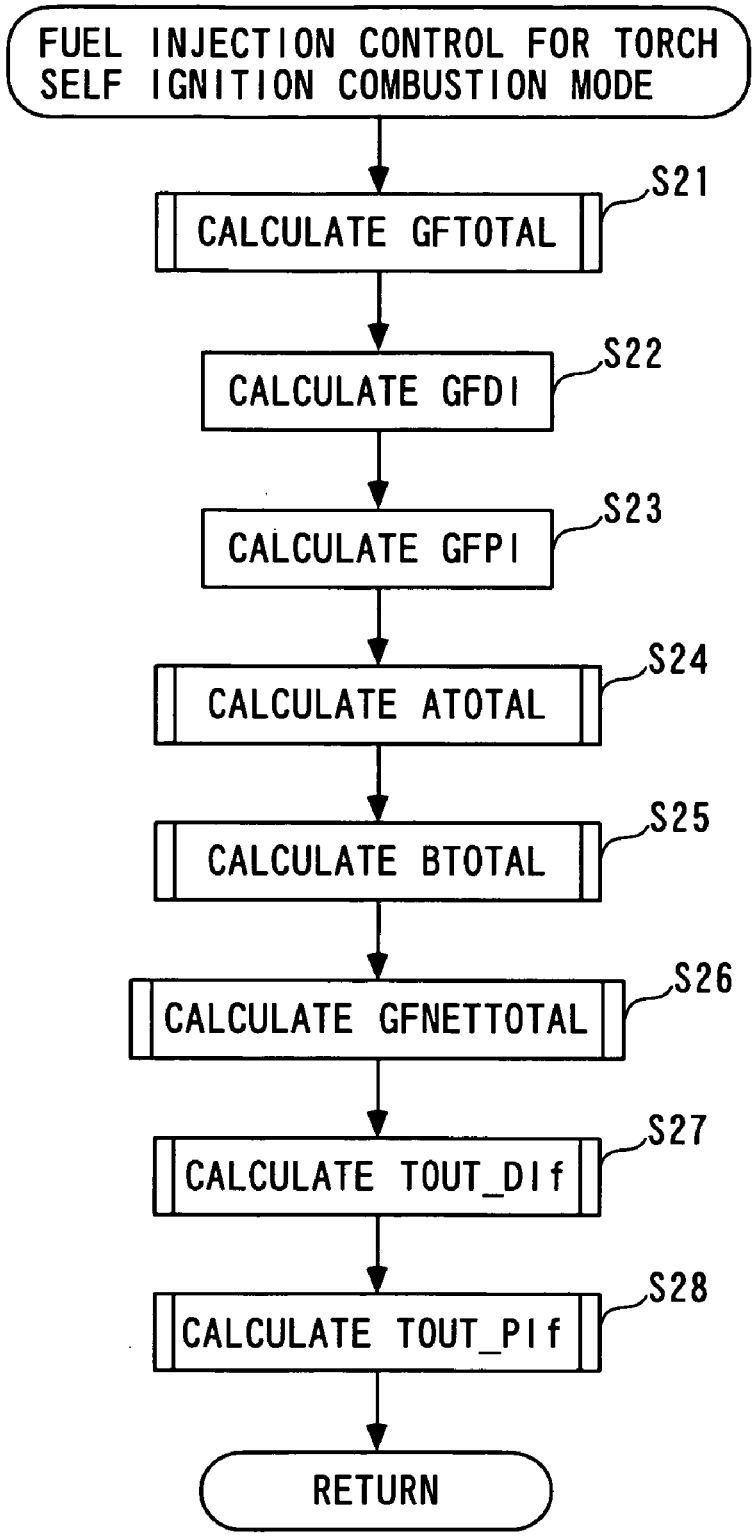
FIG. 5 is a flow chart showing a sub-routine of the fuel injection control process for a torch self ignition combustion mode at step 16 in FIG. 4.

In the following, the fuel injection control process for the torch self ignition combustion mode at step 16 will be described with reference to FIG. 5. As described above, unlike the other combustion modes, in the torch self ignition combustion mode, the fuel is supplied to the engine 3 by both of the in-cylinder fuel injection valve 6 and the port fuel injection valve 8. As such, in this process, a variety of parameters are calculated for controlling the in-cylinder fuel injection valve 6 and the port fuel injection valve 8.

First, at step 21, a total required fuel amount GFTOTAL is calculated. This total required fuel amount GFTOTAL represents the amount of fuel required to the whole cylinder 3*a*, and is equal to the sum total of the in-cylinder fuel injection amount GFDI and the port fuel injection amount GFPI.

Figure 6:
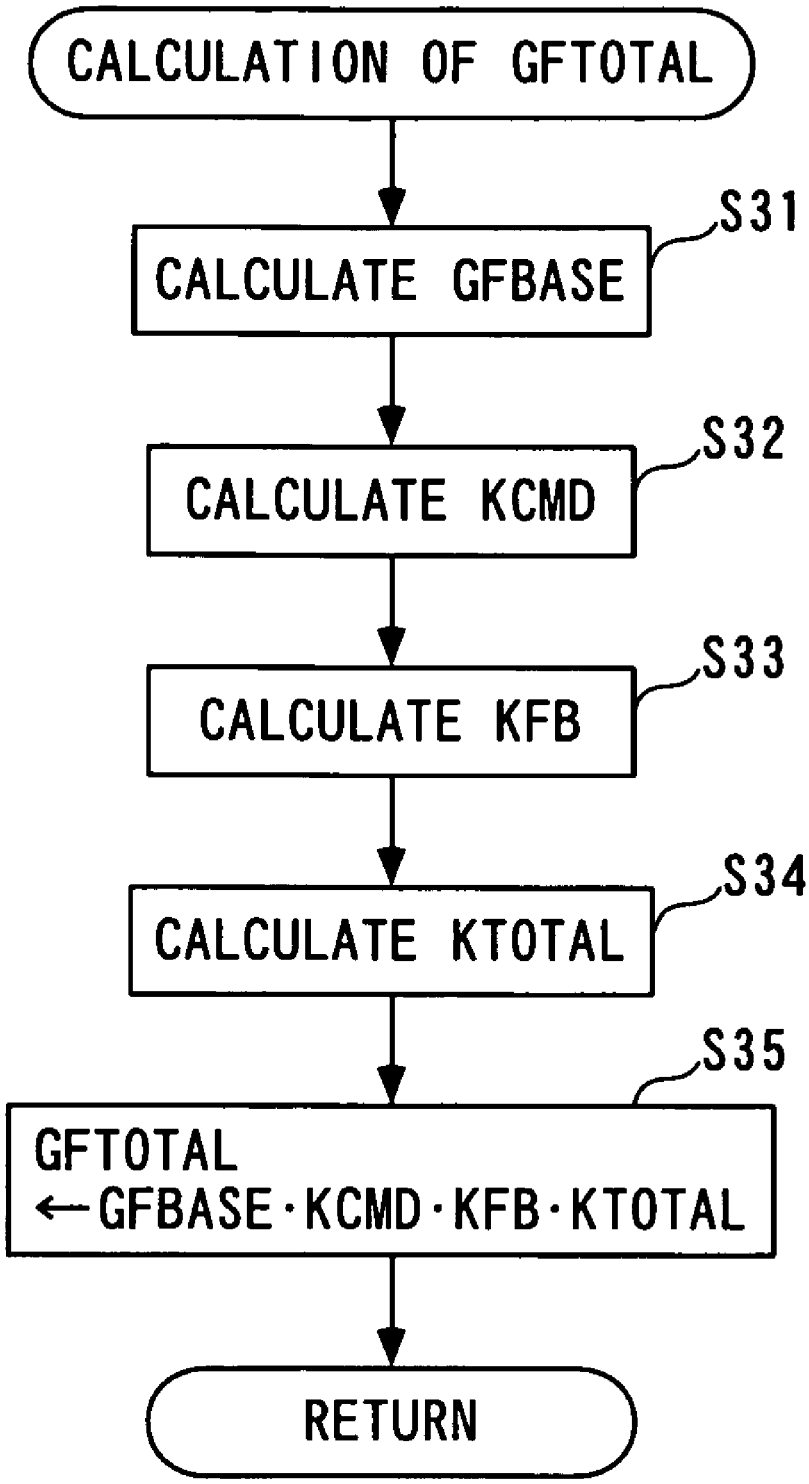
FIG. 6 is a flow chart showing a subroutine for calculating a total required fuel amount GFTOTAL.

FIG. 6 is a subroutine for calculating the total required fuel amount GFTOTAL. At step 31, a basic value GFBASE of the total required fuel amount is calculated. Specifically, an intake air amount GAIRCYL per combustion cycle is found by dividing an air mass GAIR detected by the air flow meter 23 by the engine rotational speed NE, or the like, and the intake air amount GAIRCYL is divided by the value of 14.7 which is comparable to the stoichiometric air-fuel ratio to calculate the basic value GFBASE.

Next, a target air-fuel ratio KCMD is calculated by searching a map (not shown) in accordance with the engine rotational speed NE and the required torque PMCMD for each combustion mode (step 32). Next, a feedback correction coefficient KFB is calculated by a predetermined feedback control algorithm in accordance with a deviation of a detected air-fuel ratio KACT from the calculated target air-fuel ratio KCMD (step 33).

Next, a total correction coefficient KTOTAL is calculated other than the two coefficients (step 34). This total correction coefficient KTOTAL is derived by multiplying a water temperature correction coefficient, which is set in accordance with the engine water temperature, and the like by one another.

Next, the total required fuel amount GFTOTAL is calculated by the following equation (1) by multiplying the basic value GFBASE calculated in the foregoing manner by the target air-fuel ratio coefficient KCMD, the feedback correction coefficient KFB, and the total correction coefficient KTOTAL (step 35), followed by the termination of this process:

$$GF\mathrm{TOTAL}=GF\mathrm{BASE}\cdot KCMD\cdot KFB\cdot K\mathrm{TOTAL} \quad (1)$$

Turning back to FIG. 5, at step 22 subsequent to the aforementioned step 21, an in-cylinder fuel injection amount GFDI is calculated by searching a map (not shown) in accordance with the engine rotational speed NE and the required torque PMCMD.

Next, the in-cylinder fuel injection amount GFDI calculated at step 22 is subtracted from the total required fuel amount GFTOTAL calculated at step 21 to calculate the port fuel injection amount GFPI (step 23).

Next, a total direct ratio ATOTAL is calculated (step 24). This total direct ratio ATOTAL represents the proportion of a fuel amount actually burnt in the combustion chamber 3 in the current combustion cycle to the total fuel amount injected from the in-cylinder fuel injection valve 6 and port fuel injection valve 8 in the current combustion cycle.

Figure 7:
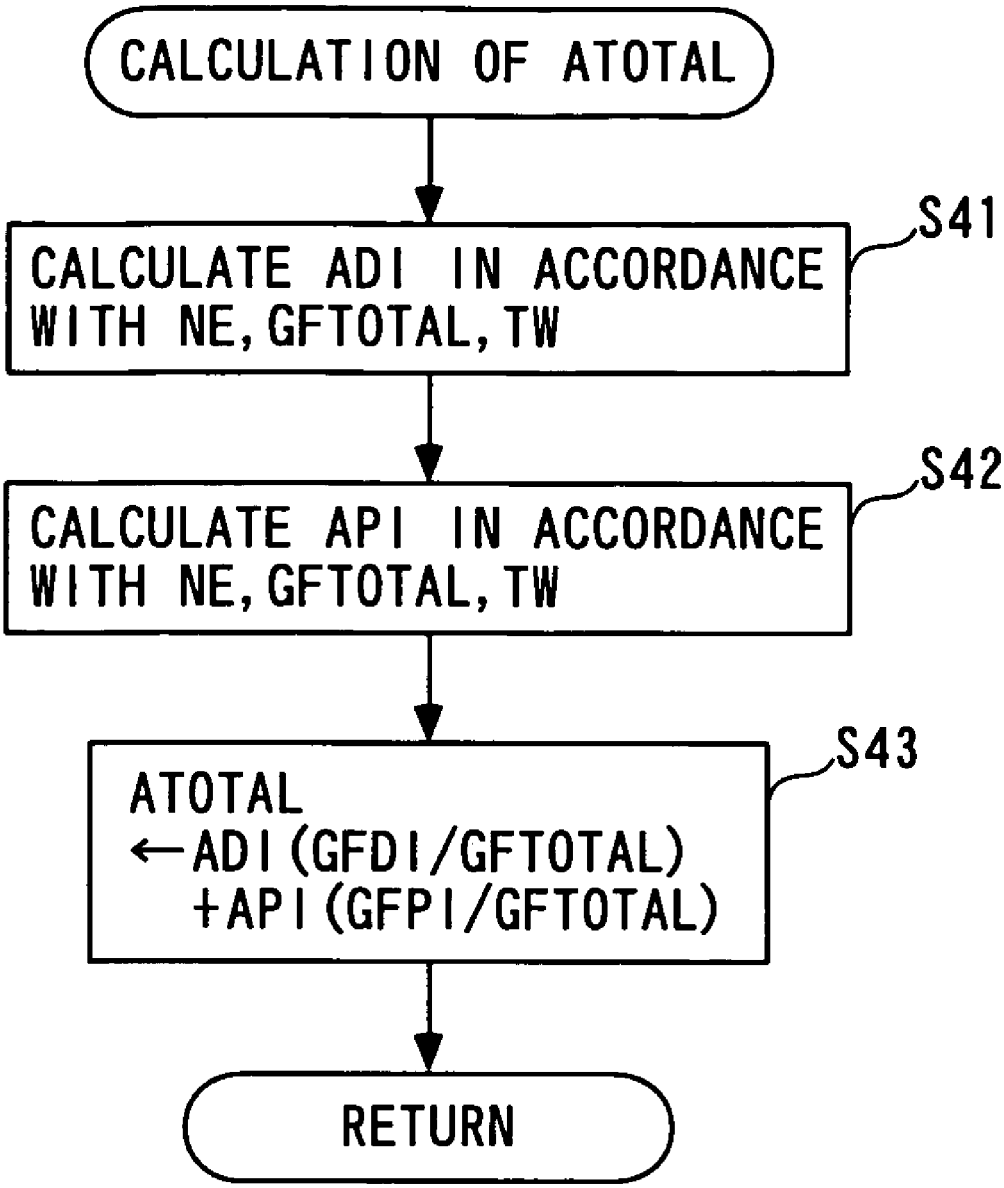
FIG. 7 is a flow chart showing a subroutine for calculating a total direct ratio ATOTAL.
Figure 8:
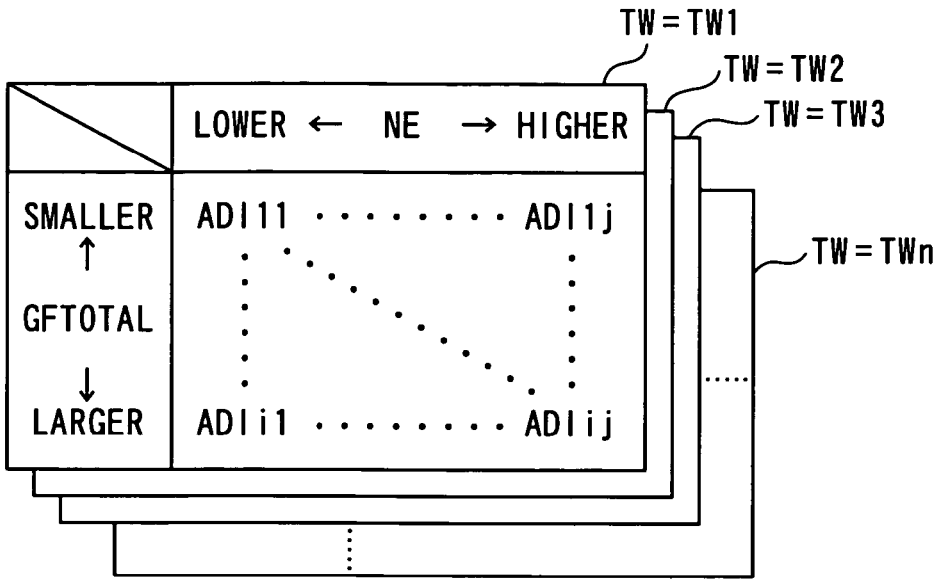
FIG. 8 is an example of an ADI map used in the process of FIG. 7

FIG. 7 shows its calculation subroutine. At step 41, an in-cylinder injection direct ratio ADI is calculated by searching an ADI map shown in FIG. 8 in accordance with the engine rotational speed NE, the total required fuel amount GFTOTAL calculated at the aforementioned step 21, and the engine water temperature TW. This in-cylinder injection direct ratio ADI represents the proportion of a fuel amount actually burnt in the current cycle, without sticking to the inner wall of the combustion chamber 3*d* (the inner wall surface of the cylinder 3*a* and the outer surface of the piston 3*b*) to the fuel amount injected from the in-cylinder fuel injection valve 6 in the current combustion cycle.

The AID map is comprised of a plurality of ADI maps which are set for each of a plurality of predetermined engine water temperatures TW (=TW1–TWn), where the in-cylinder injection direction ratio ADI is set to a smaller value as the engine water temperature TW is lower. This is because an injected fuel is less apt to vaporize and is more likely to stick to the inner wall surface of the combustion chamber 3*d* as the engine water temperature TW is lower.

Figure 9:
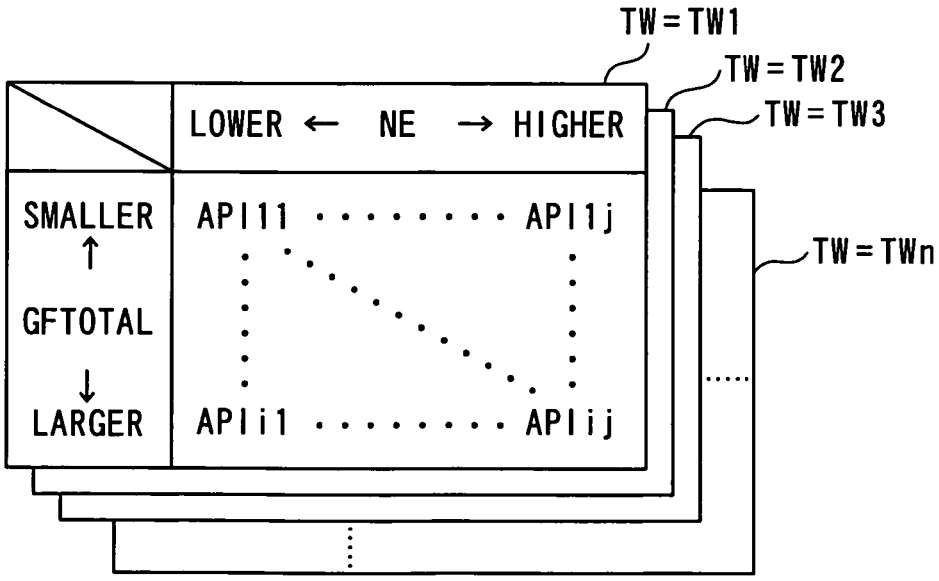
FIG. 9 is an example of an API map used in the process of FIG. 7.

Next, at step 42, a port injection direct ratio API is calculated by searching an API map shown in FIG. 9 in accordance with the engine rotational speed NE, the total required fuel amount GFTOTAL, and the engine water temperature TW. This port injection direct ratio API represents the proportion of a fuel amount actually burnt in the current combustion cycle without sticking to the inner wall of the intake pipe 4 to the fuel amount injected from the port fuel injection valve 8 in the current cycle.

The API map is also comprised of a plurality of API maps which are set for each of a plurality of predetermined engine water temperatures TW (=TW1–TWn), like the ADI map mentioned above, where the port injection direction ratio API is set to a smaller value as the engine water temperature TW is lower, because an injected fuel is less apt to vaporize and is more likely to stick to the inner wall surface of the combustion chamber 3*d* as the engine water temperature TW is lower.

Next, the total direct ratio ATOTAL is calculated by the following equation (2) using the in-cylinder injection direct ratio ADI and port injection direct ratio API calculated as described above (step 43), followed by the termination of this process.

$$ATOTAL = ADI \cdot (GFDI / GFTOTAL) + ADI \cdot \left(\frac{GFPI}{GFTOTAL}\right) \quad (2)$$

As is apparent from this equation (2), the total direct ratio ATOTAL is a weighted average of the in-cylinder injection direct ratio ADI and the port injection direct ratio API in accordance with the ratios of the required in-cylinder injection amount GFDI and the required port injection amount GFPI to the total required fuel amount GFTOTAL, and therefore represents a direct ratio as the whole cylinder 3*a*.

Turning back to FIG. 5, at step 25 subsequent to the aforementioned step 24, a total take-away ratio BTOTAL is calculated. This total take-away ratio BTOTAL represents the proportion of a fuel amount actually burnt in the current combustion cycle within a total sticking fuel amount which has stuck to the inner wall surface of the combustion chamber 3*d* and the inner wall surface of the intake pipe 4 at the end of the preceding combustion cycle, to the total sticking fuel amount.

Figure 10:
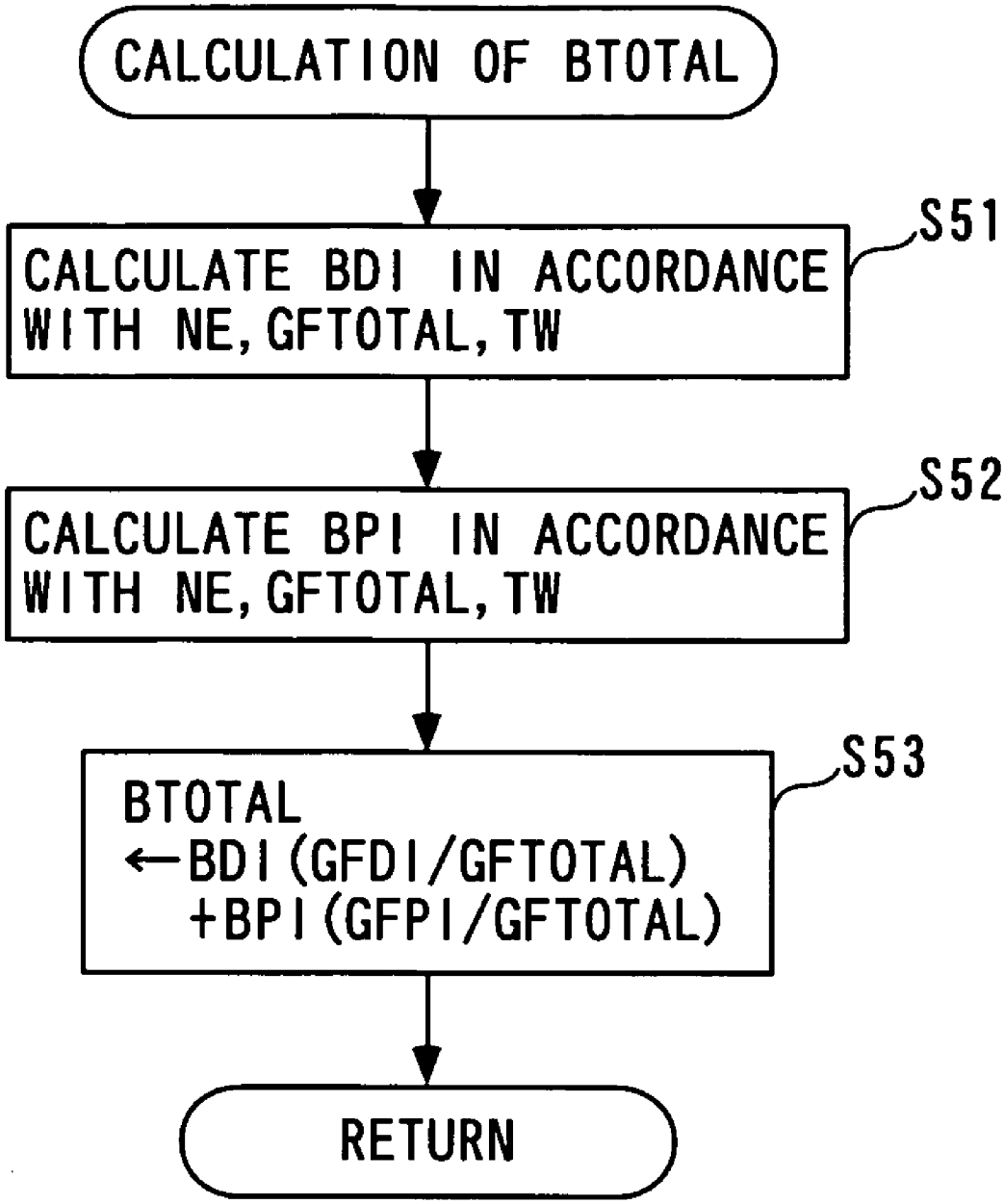
FIG. 10 is a subroutine for calculating a total take-away ratio BTOTAL.
Figure 11:
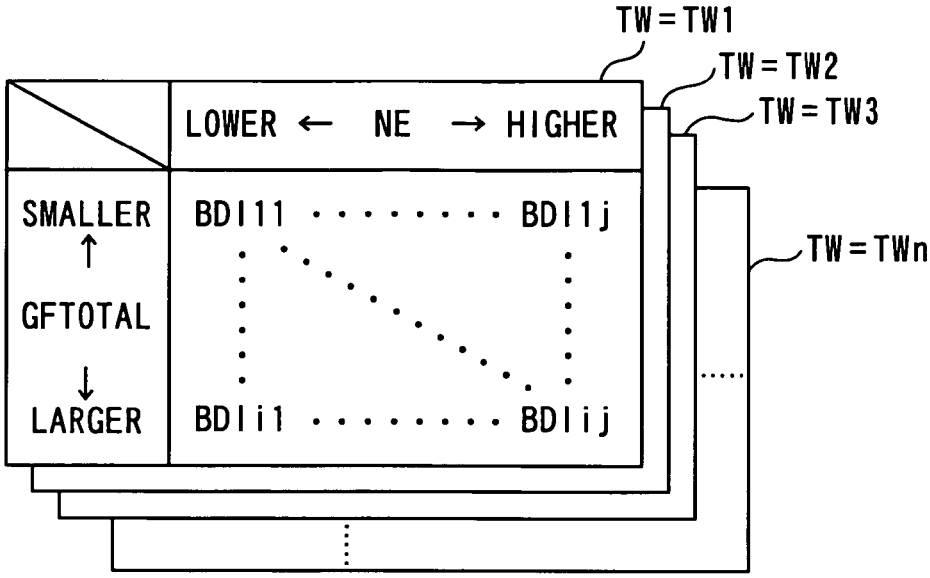
FIG. 11 is an example of a BDI map used in the process of FIG. 10.

FIG. 10 shows its calculation subroutine. At step 51, an in-cylinder injection take-away ratio BDI is calculated by searching a BDI map shown in FIG. 11 in accordance with the engine rotational speed NE, the total required fuel amount GFTOTAL, and the engine water temperature TW. This in-cylinder injection take-away ratio BDI represents the proportion of a fuel amount actually burnt in the current cycle within a sticking fuel amount which has stuck to the inner wall surface of the combustion chamber 3*d* at the end of the preceding combustion cycle, to the sticking fuel amount.

The BDI map is comprised of a plurality of BDI maps which are set for each of a plurality of predetermined engine water temperatures TW (=TW1–TWn), where the in-cylinder injection take-away ratio BDI is set to a smaller value as the engine water temperature is lower. This is because the fuel sticking to the inner wall surface of the combustion chamber 3*d* is less apt to vaporize and is less likely to be taken away as the engine water temperature TW is lower.

Figure 12:
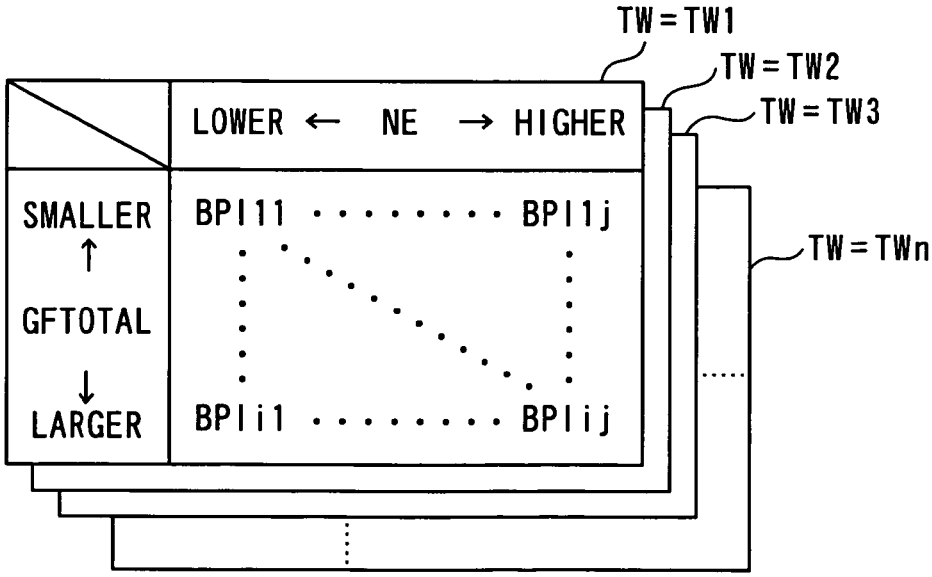
FIG. 12 is an example of a BPI map used in the process of FIG. 10.

Next, at step 52, a port injection take-away ratio BPI is calculated by searching a BPI map shown in FIG. 12 in accordance with the engine rotational speed NE, the total required fuel amount GFTOTAL, and the engine water temperature TW. This port injection take-away ratio BPI represents the proportion of a fuel amount actually burnt in the current combustion cycle within a sticking fuel amount which has stuck to the inner wall surface of the intake pipe 4 at the end of the preceding combustion cycle, to the sticking fuel amount.

This BPI map is also comprised of a plurality of BPI maps which are set for each of a plurality of predetermined engine water temperatures TW (=TW1–TWn), like the BDI map mentioned above, where the port injection take-away ratio BPI is set to a smaller value as the engine water temperature is lower, because the fuel sticking to the inner wall surface of the intake pipe 4 is less apt to vaporize and is less likely to be taken away as the engine water temperature TW is lower.

Next, the total take-away ratio BTOTAL is calculated by the following equation (3) using the calculated in-cylinder injection take-away ratio BDI and port injection take-away ratio BPI (step 53), followed by the termination of this process:

$$BTOTAL = BDI \cdot (GFDI / GFTOTAL) + BPI \cdot \left(\frac{GFPI}{GFTOTAL}\right) \quad (3)$$

As is apparent from the equation (3), the total take-away ratio BTOTAL is also a weighted average of the in-cylinder injection take-away ratio BDI and the port injection take-away ratio BPI in accordance with the ratio of the required in-cylinder injection amount GFDI and the required port injection amount GFPI to the total required fuel amount GFTOTAL, and therefore represents a take-away ratio as the whole cylinder 3*a*.

Turning back to FIG. 5, at step 26 subsequent to the aforementioned step 25, a total net injection amount GFNETTOTAL is calculated by the following equation (4):

$$GFNETTOTAL=(GFTOTAL-BTOTAL \cdot TWP)/ATOTAL \quad (4)$$

Here, the total net injection amount GFNETTOTAL represents the sum total of the fuel amounts which should be injected from the in-cylinder fuel injection valve 6 and the port fuel injection valve 8, which is derived by taking into consideration the total direct ratio ATOTAL and the total take-away ratio BTOTAL in addition to the total required fuel amount GFTOTAL.

Also, TPW in the equation (4) is comparable to a total sticking fuel amount which sticks to the inner wall surface of the combustion chamber 4*d* and to the inner wall surface of the intake pipe 4, and is calculated by the following equation (5):

$$TWP(n) = GFTOTAL \cdot (1 - ATOTAL) + (1 - BTOTAL) \cdot TWP(n-1) \quad (5)$$

Here TWP(n) and TWP(n−1) are a current value and a preceding value of the total sticking fuel amount.

Figure 13:
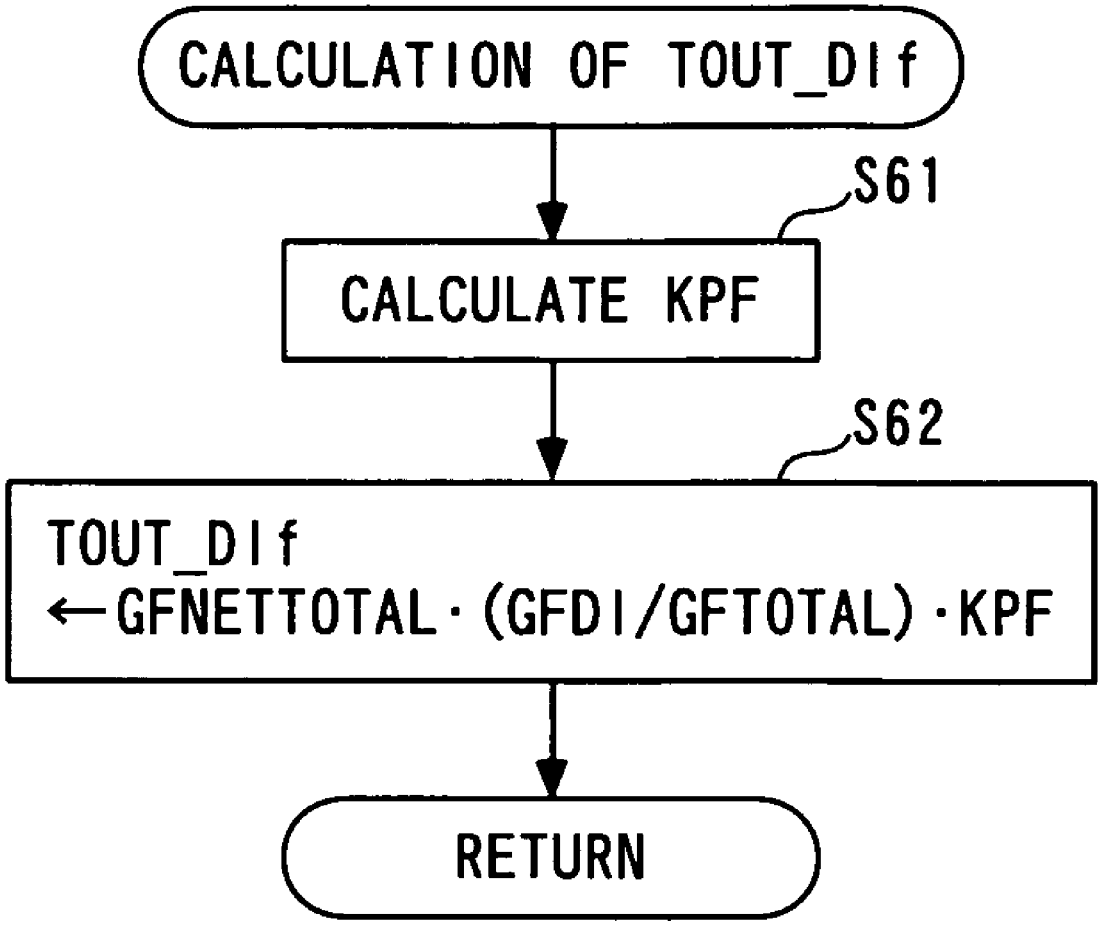
FIG. 13 is a flow chart showing a subroutine for calculating an in-cylinder injection time TOUT_DIf.
Figure 14:
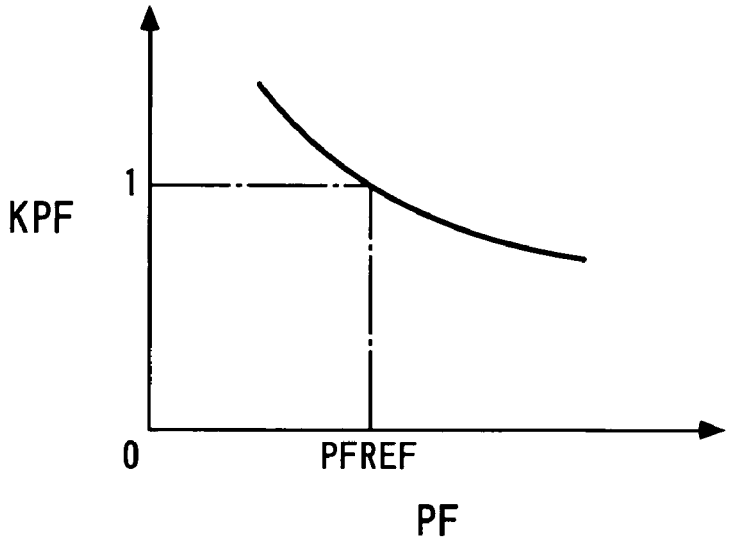
FIG. 14 is an example of a KPF table used in the process of FIG. 13.

Next, an in-cylinder fuel injection time TOUT_DIf is calculated (step 27). FIG. 13 shows its calculation subroutine. First, at step 61, a fuel pressure correction coefficient KPF is calculated by searching a KPF table shown in FIG. 14 in accordance with the in-cylinder fuel pressure PF. In the KPF table, the fuel pressure correction coefficient KPF is set at the value of one when the in-cylinder fuel pressure PF is at the reference in-cylinder fuel pressure PFREF, and is set to a larger value as the in-cylinder fuel pressure PF is lower, because the actual in-cylinder fuel injection amount becomes smaller as the in-cylinder fuel pressure PF is lower for the same valve opening time of the in-cylinder fuel injection valve 6.

Next, the in-cylinder injection time TOUT_DIf is calculated by the following equation (6) (step 62), followed by the termination of this process:

$$TOUT_DIf=GFNETTOTAL \cdot (GFDI/GFTOTAL) \cdot KPF \quad (6)$$

Figure 15:
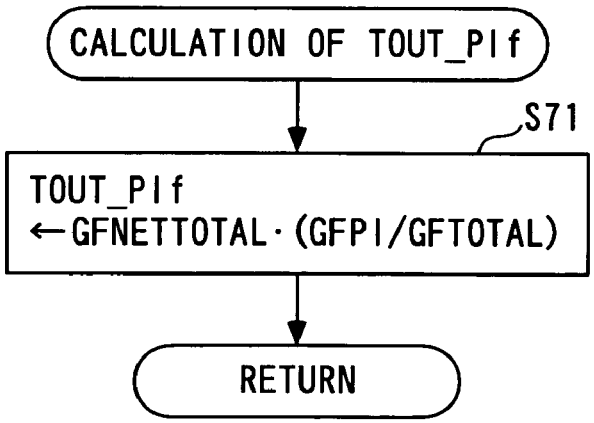
FIG. 15 is a flow chart showing a subroutine for calculating a port injection time TOUT_PIf.

Turning back to FIG. 5, at step 28 subsequent to the aforementioned step 27, a port injection time TOUT_PIf which is a valve opening time of the port fuel injection valve 8 is calculated, followed by the termination of this process. FIG. 15 shows its calculation subroutine. At step 71, the port injection time TOUT_PIf is calculated by the following equation (7):

$$TOUT_PIf=GFNETTOTAL \cdot (GFPI/GFTOTAL) \quad (7)$$

As is apparent from the foregoing equations (6) and (7), the in-cylinder injection time TOUT_DIf and the port injection time TOUT_PIf are calculated by proportionally distributing the total net injection amount GFNETTOTAL found at step 26 in accordance with the ratios of the required in-cylinder injection amount and the required port injection amount GFPI.

As described above, according to this embodiment, the in-cylinder injection direct ratio ADI and the in-cylinder injection take-away ratio BDI, which represent fuel transport behaviors of the fuel injected from the in-cylinder fuel injection valve 6, and the port injection direct ratio API and the port injection take-away ratio BPI, which represent fuel transport behaviors of the fuel injected from the port fuel injection valve 8, are calculated as fuel behavior parameters, and the in-cylinder injection time TOUT_DIf of the in-cylinder fuel injection valve 6 and the port injection time TOUT_PIf of the port fuel injection valve 6 are calculated in accordance with these calculated fuel behavior parameters.

Accordingly, the amount of fuel actually used in the combustion chamber 3*d* for combustion can be appropriately controlled while satisfactorily reflecting fuel transport behaviors as the whole cylinder 3*a* including not only a transport delay due to the sticking of the fuel injected from the port fuel injection valve 8 onto the inner wall surface of the intake pipe 4, but also a transport delay due to the sticking of the fuel injected from the in-cylinder fuel injection valve 6 onto the inner wall surface of the combustion chamber 3*d*, and the like, thereby making it possible to accurately control the air-fuel ratio to a desired value.

Also, since the aforementioned fuel behavior parameters are calculated in accordance with the engine water temperature TW and the total required fuel amount GFTOTAL, the fuel behavior parameters can be appropriately calculated while satisfactorily reflecting the degree to which the fuel sticks in accordance with the temperature of the engine 3, and the thickness of a fuel film in accordance with the fuel injection amount.

Further, the in-cylinder injection direct ratio ADI and the port injection direct ratio API, as well as the in-cylinder injection take-away ratio BDI and the port injection take-away ratio BPI are weight averaged in accordance with the ratios of the required in-cylinder injection amount GFDI and the required port injection amount GFPI to the total required fuel amount GFTOTAL, thereby calculate the total direct ratio ATOTAL and the total take-away ratio BTOTAL. The total fuel behavior parameters calculated in this way satisfactorily reflect fuel transport behaviors as the whole cylinder 3*a*. Also, the total net injection amount GFNETTOTAL is calculated in accordance with the total direct ratio ATOTAL and the total take-away ratio BTOTAL, and the calculated total net injection amount GFNETTOTAL is proportionally distributed in accordance with the ratios of the required in-cylinder injection amount GFDI and the required port injection amount GFPI, thereby calculating the in-cylinder injection time TOUT_DIf and the port injection time TOUT_PIf, respectively.

It is therefore possible to appropriately determine the in-cylinder injection time TOUT_DIf and the port injection time TOUT_PIf, while satisfactorily reflecting the fuel transport behaviors as the whole cylinder 3, to accurately control the air-fuel ratio to a desired value, and produce the aforementioned effects by a very simple processing approach such as weighted average, proportional distribution and the like.

Next, the fuel injection control processes for the stratified self ignition combustion mode, the stratified flame propagation combustion mode, and the homogeneous flame propagation combustion mode executed at steps 14, 15 and 17, respectively, in FIG. 4 will be described in brief. As described above, in the stratified self ignition combustion mode and the stratified flame propagation combustion mode, the fuel is supplied to the engine 3 only by the in-cylinder fuel injection valve 6, as described above. As such, the required in-cylinder injection amount GFDI is calculated in accordance with the engine rotational speed NE and the required torque PMCMD, while the in-cylinder injection direct ratio ADI and the in-cylinder injection take-away ratio BDI are calculated in accordance with the engine rotational speed NE, the required in-cylinder injection amount GFDI, and the engine water temperature TW. Then, the in-cylinder injection time TOUT_DIf is calculated by applying the in-cylinder injection direct ratio ADI, the in-cylinder injection take-away ratio BDI and the like to the required in-cylinder injection amount GFDI.

On the other hand, in the homogeneous flame propagation combustion mode, the fuel is supplied to the engine 3 mainly by the port fuel injection valve 8 alone, as described above. As such, the required port injection amount GFPI is calculated in accordance with the engine rotational speed NE and the required torque PMCMD, while the port injection direct ratio API and the port injection take-away ratio BPI are calculated in accordance with the engine rotational speed NE, the required port injection amount GFPI, and the engine water temperature TW. Then, the port injection time TOUT_DIf is calculated by applying the port injection direct ratio API, the port injection take-away ratio BPI and the like to the required port injection amount GFPI.

It should be understood that the present invention is not limited to the embodiment described above, but can be practiced in a variety of manners. For example, while the foregoing embodiment uses the total required fuel amount GFTOTAL as one of parameters for calculating the in-cylinder injection direct ratio ADI and the like, a required injection amount of a corresponding fuel injection valve may be used instead thereof. Specifically, the required in-cylinder injection amount GFDI may be used for calculating the in-cylinder injection direct ratio ADI and the in-cylinder injection take-away ratio BDI, while the required port injection amount GFPI may be used for calculating the port injection direct ratio API and the port injection take-away ratio BPI.

Also, while the embodiment has shown an example in which the in-cylinder injection from the in-cylinder fuel injection valve 6 is performed at one time, the present invention can also be applied to a scenario in which the in-cylinder injection is performed in multiple stages, for example, divided into an intake stroke, a compression stroke and the like, in which case fuel behavior parameters indicative of fuel transport behaviors of the fuel injected in each stage are calculated, respectively.

Further, while the embodiment has shown an example in which the present invention is applied to the engine 3 for a vehicle, the present invention is not so limited, but can be applied to an engine for vessel propeller such as an outboard engine which has a crank shaft arranged in the vertical direction, and other internal combustion engines for industrial use. Otherwise, details in configuration can be modified as appropriate without departing from the spirit and scope of the invention set forth in the appended claims.

What is claimed is:

1. A fuel injection control apparatus for an internal combustion engine which is supplied with a fuel by an in-cylinder fuel injection vale for injecting the fuel into a cylinder, and a port fuel injection valve for injecting the fuel into an intake system including an intake port, said apparatus comprising:

required in-cylinder injection amount calculating means for calculating a required in-cylinder injection amount required for said in-cylinder fuel injection valve;

required port injection amount calculating means for calculating a required port injection amount required for said port fuel injection valve;

in-cylinder injected fuel behavior parameter calculating means for calculating an in-cylinder injected fuel behavior parameter indicative of a transport behavior of a fuel injected by said in-cylinder fuel injection valve, the transport behavior including a transport delay due to the sticking of the fuel injected from the in-cylinder fuel injection valve onto inner wall surface of the combustion engine;

port injected fuel behavior parameter calculating means for calculating a port injected fuel behavior parameter indicative of a transport behavior of the fuel injected by said port fuel injection valve, the transport behavior including a transport delay due to the sticking of the fuel injected from the port fuel injection valve onto inner wall surface of the intake port;

net in-cylinder injection amount determining means for determining a net in-cylinder injection amount which should be injected from said in-cylinder fuel injection valve in accordance with the calculated in-cylinder injected fuel behavior parameter and port injected fuel behavior parameter based on the calculated required in-cylinder injection amount; and net port injection amount determining means for determining a net port injection amount which should be injected from said port fuel injection valve in accordance with the in-cylinder injected fuel behavior parameter and the port injected fuel behavior parameter based on the calculated required port injection amount.

2. A fuel injection control apparatus for an internal combustion engine according to claim 1, further comprising:

load detecting means for detecting a load of said internal combustion engine;

total required fuel amount calculating means for calculating a total required fuel amount required for said whole cylinder based on the detected load of the internal combustion engine; and engine temperature detecting means for detecting a temperature of said internal combustion engine, wherein said in-cylinder injected fuel behavior parameter calculating means calculates the in-cylinder injected fuel behavior parameter in accordance with one of the calculated total required fuel amount and the required in-cylinder injection amount and the detected temperature of the internal combustion engine, and said port injected fuel behavior parameter calculating means calculates the port injected fuel behavior parameter in accordance with one of the total required fuel amount and the required port injection amount and the temperature of said internal combustion engine.

3. A fuel injection control apparatus for an internal combustion engine according to claim 2, further comprising:

total fuel behavior parameter calculating means for calculating a total fuel behavior parameter indicative of a transport behavior of the fuel as said whole cylinder by weight averaging the in-cylinder injected fuel behavior parameter and the port injected fuel behavior parameter in accordance with ratios of the required in-cylinder injection amount and the required port injection amount to the total required fuel amount; and total net injection amount calculating means for calculating a total net injection amount which is a sum total of fuel amounts that should be injected from said in-cylinder fuel injection valve and said port fuel injection valve in accordance with the calculated total fuel behavior parameter, wherein said net in-cylinder injection amount determining means and said net port injection amount determining means determine the net in-cylinder injection amount and the net port injection amount, respectively, by proportionally distributing the calculated total net injection amount in accordance with ratios of the required in-cylinder injection amount and the required port injection amount.

4. A fuel injection control method for an internal combustion engine which is supplied with a fuel by an in-cylinder fuel injection valve for injecting the fuel into a cylinder, and a port fuel injection valve for injecting the fuel into an intake system including an intake port, said method comprising the steps of:

calculating a required in-cylinder injection amount required for said in-cylinder fuel injection valve;

calculating a required port injection amount required for said port fuel injection valve;

calculating an in-cylinder injected fuel behavior parameter indicative of a transport behavior of a fuel injected by said in-cylinder fuel injection valve, the transport behavior including a transport delay due to the sticking of the fuel injected from the in-cylinder fuel injection valve onto inner wall surface of the combustion engine;

calculating a port injected fuel behavior parameter indicative of a transport behavior of the fuel injected by said port fuel injection valve, the transport behavior including a transport delay due to the sticking of the fuel injected from the port fuel injection valve onto inner wall surface of the intake port;

determining a net in-cylinder injection amount which should be injected from said in-cylinder fuel injection valve in accordance with the calculated in-cylinder injected fuel behavior parameter and port injected fuel behavior parameter based on the calculated required in-cylinder injection amount; and determining a net port injection amount which should be injected from said port fuel injection valve in accordance with the in-cylinder injected fuel behavior parameter and the port injected fuel behavior parameter based on the calculated required port injection amount.

5. A fuel injection control method for an internal combustion engine according to claim 4, further comprising the step of:

detecting a load of said internal combustion engine;

calculating a total required fuel amount required for said whole cylinder based on the detected load of the internal combustion engine; and detecting a temperature of said internal combustion engine, wherein said in-cylinder injected fuel behavior parameter calculating step includes calculating the in-cylinder injected fuel behavior parameter in accordance with one of the calculated total required fuel amount and the required in-cylinder injection amount and the detected temperature of the internal combustion engine, and said port injected fuel behavior parameter calculating step includes calculating the port injected fuel behavior parameter in accordance with one of the total required fuel amount and the required port injection amount and the temperature of said internal combustion engine.

6. A fuel injection control method for an internal combustion engine according to claim 5, further comprising the step of:

calculating a total fuel behavior parameter indicative of a transport behavior of the fuel as said whole cylinder by weight averaging the in-cylinder injected fuel behavior parameter and the port injected fuel behavior parameter in accordance with ratios of the required in-cylinder injection amount and the required port injection amount to the total required fuel amount; and calculating a total net injection amount which is a sum total of fuel amounts that should be injected from said in-cylinder fuel injection valve and said port fuel injection valve in accordance with the calculated total fuel behavior parameter, wherein said net in-cylinder injection amount determining step and said net port injection amount determining step include determining the net in-cylinder injection amount and the net port injection amount, respectively, by proportionally distributing the calculated total net injection amount in accordance with ratios of the required in-cylinder injection amount and the required port injection amount.

* * * * *